US006928987B2

(12) United States Patent
Nakamura

(10) Patent No.: US 6,928,987 B2
(45) Date of Patent: Aug. 16, 2005

(54) FIXING STRUCTURE FOR FUEL INJECTION NOZZLE

(75) Inventor: Akihide Nakamura, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/994,308

(22) Filed: Nov. 23, 2004

(65) Prior Publication Data

US 2005/0121002 A1 Jun. 9, 2005

(30) Foreign Application Priority Data

Dec. 8, 2003 (JP) ..... 2003-409172

(51) Int. Cl.[7] ..... F02M 61/14; F02B 67/00
(52) U.S. Cl. ..... 123/470; 123/509
(58) Field of Search ..... 123/470, 469, 123/509, 468, 472, 456, 193.3, 90.27

(56) References Cited

U.S. PATENT DOCUMENTS 4,571,161 A * 2/1986 Leblanc et al. ..... 417/499
5,329,906 A * 7/1994 Jensen et al. ..... 123/470
5,499,612 A * 3/1996 Haughney et al. ..... 123/470
5,794,595 A * 8/1998 Berger et al. ..... 123/470
5,899,190 A * 5/1999 Nakagomi et al. ..... 123/470
6,116,218 A 9/2000 Sato et al.
6,196,194 B1 * 3/2001 Mitchell ..... 123/470
6,302,088 B1 * 10/2001 Kato ..... 123/470
6,431,152 B1 * 8/2002 Estacio ..... 123/470
2004/0069280 A1 4/2004 Evancik et al.

FOREIGN PATENT DOCUMENTS

FR 2 756 872 A1 6/1998
JP 10-82355 A 3/1998

* cited by examiner

*Primary Examiner*—Weilun Lo
(74) *Attorney, Agent, or Firm*—Foley & Lardner LLP

(57) ABSTRACT

A nozzle fixing structure which fixes a fuel injection nozzle is used in an engine having a cylinder block and a cylinder head (11). The nozzle fixing structure includes a nozzle pressing arm (14) having a through hole (14*a*), which fixes a fuel injection nozzle (13); a fixing bolt (15) which is passed through the through hole (14*a*) in the nozzle pressing arm (14) and tightened to the cylinder head (11); and a cylinder head bolt (20) which is passed through the cylinder head (11) and tightened to the cylinder block. The nozzle pressing arm (14) includes a pressing part (14A) formed on one side of the through hole (14*a*) and causing a load to act on the fuel injection nozzle (13); and a supported part (14B) formed on another side of the through hole (14*a*) and constituting the pivot part (21) for the nozzle pressing arm (14) together with the upper end (20*c*) of the cylinder head bolt (20).

7 Claims, 5 Drawing Sheets

FIXING STRUCTURE FOR FUEL INJECTION NOZZLE

TECHNICAL FIELD OF THE INVENTION

This invention relates to an improved nozzle fixing structure for fixing a fuel injection nozzle to a cylinder head in a direct injection engine.

BACKGROUND OF THE INVENTION

In a multi-valve direct injection engine, a fuel injection nozzle is typically mounted in a position above the central part of a combustion chamber so as to be surrounded by an intake valve or exhaust valve. When the nozzle is disposed in this manner, it is difficult to design a fixing structure for the nozzle due to layout restrictions arising from the need to avoid interference with the moving valves.

Tokkai Hei10-82355, published by the Japan Patent Office in 1998, discloses a fixing structure for a nozzle. In this prior art, a nozzle pressing arm is provided in a comparatively high position above a cylinder head to prevent interference with a camshaft. One end of the nozzle pressing arm presses the nozzle, while the other end of the nozzle pressing arm is supported by an additional pin implanted in the cylinder head.

SUMMARY OF THE INVENTION

However, when the length of the additional pin increases due to the high position of the nozzle pressing arm, it is difficult to ensure that the pin has sufficient support rigidity. When the additional pin is increased in size (or diameter) to ensure sufficient rigidity, a large space is required above the cylinder head.

An object of this invention is to provide a nozzle fixing structure having excellent rigidity.

In order to achieve the above object, this invention provides a nozzle fixing structure which fixes a fuel injection nozzle used in an engine having a cylinder block and a cylinder head. The nozzle fixing structure comprises a nozzle pressing arm which fixes a fuel injection nozzle positioned above a combustion chamber of the engine to the cylinder head. The nozzle pressing arm comprises a through hole. The nozzle fixing structure further comprises a fixing bolt which is passed through the through hole in the nozzle pressing arm and tightened to the cylinder head in order to fix the nozzle pressing arm above the cylinder head. The nozzle fixing structure yet further comprises a cylinder head bolt which is passed through the cylinder head and tightened to the cylinder block in order to fix the cylinder head to the cylinder block, an upper end of the cylinder head bolt supporting the nozzle pressing arm and constituting a pivot part for the nozzle pressing arm.

The nozzle pressing arm comprises a pressing part formed on one side of the through hole. The pressing part causes a load to act on the fuel injection nozzle in an axial direction of the fuel injection nozzle when the fixing bolt is tightened to the cylinder head. The nozzle pressing arm further comprises a supported part formed on another side of the through hole. The supported part is supported by the upper end of the cylinder head bolt, and the supported part constitutes the pivot part for the nozzle pressing arm together with the upper end of the cylinder head bolt.

The details as well as other features and advantages of this invention are set forth in the remainder of the specification and are shown in the accompanying drawings.

PREFERRED EMBODIMENTS OF THE INVENTION

Figure 1:
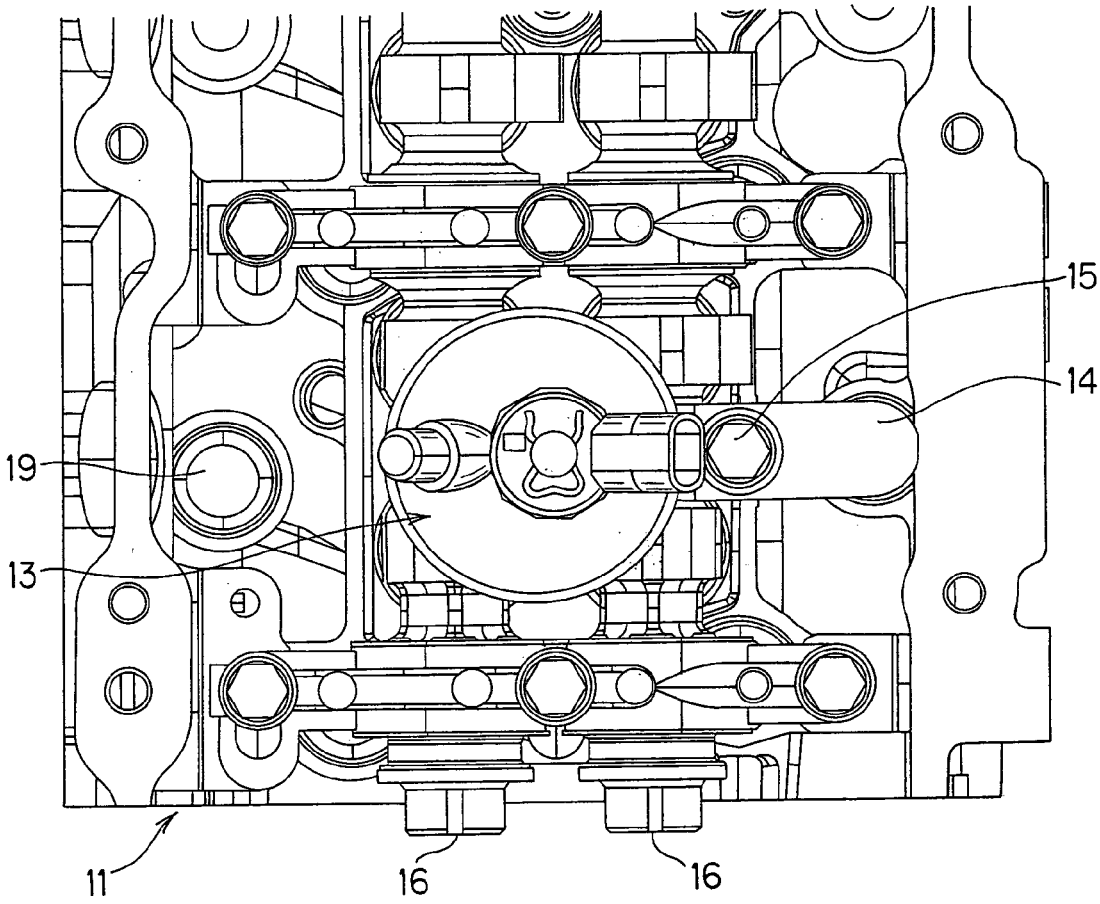
FIG. 1 is a plan view of a cylinder head according to an embodiment.
Figure 2:
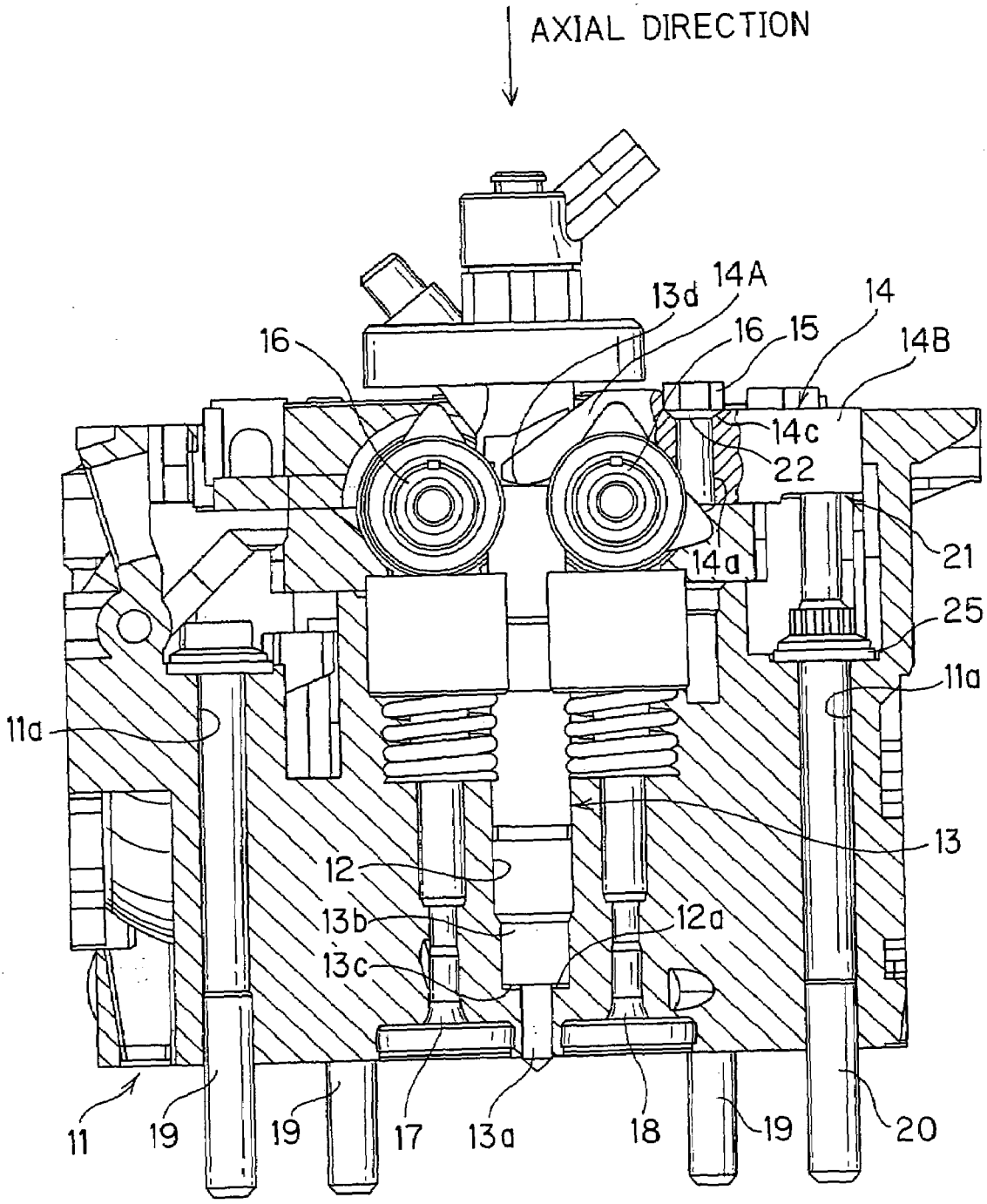
FIG. 2 is a sectional front view of the cylinder head according to the embodiment.
Figure 3:
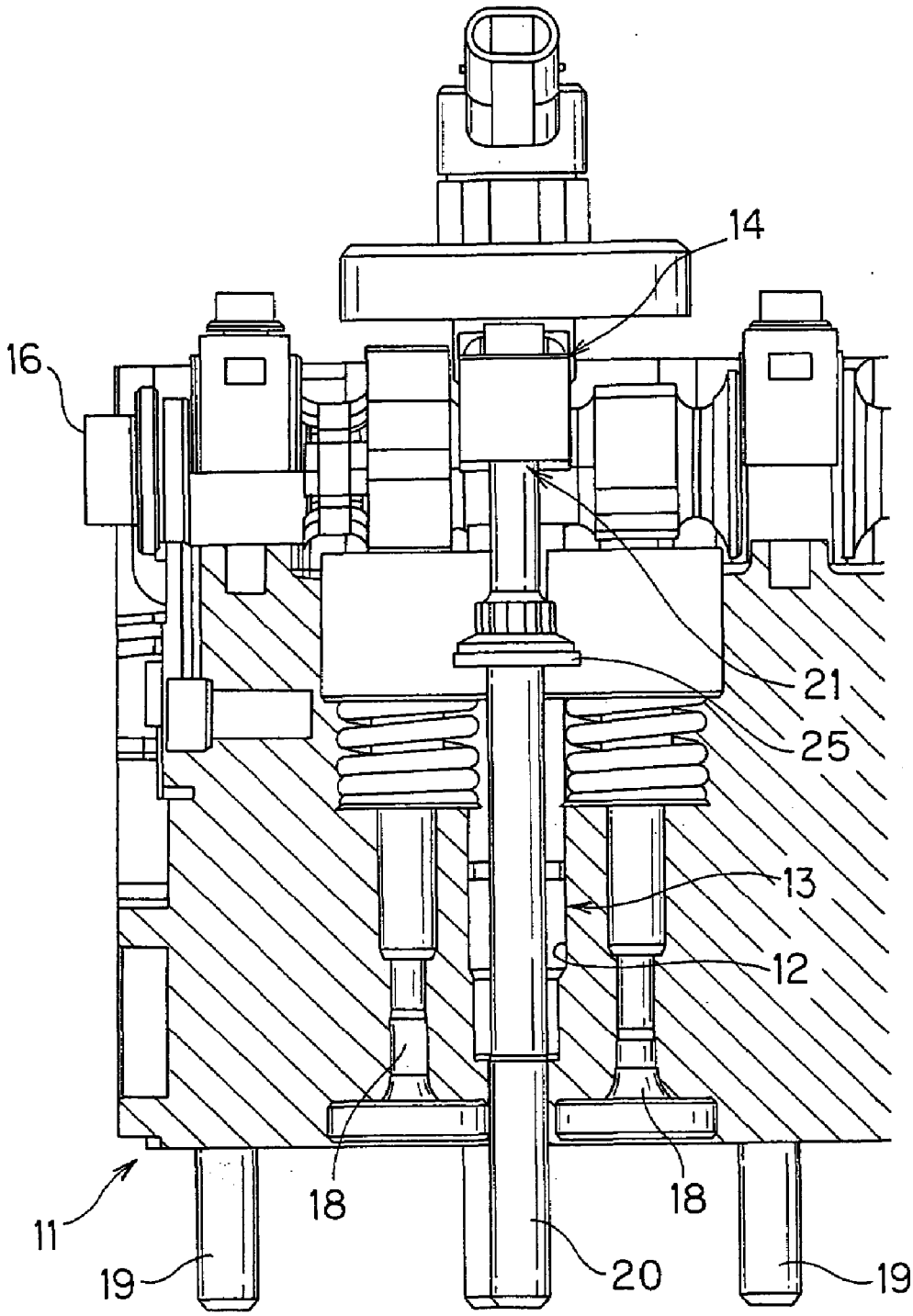
FIG. 3 is a sectional side view of the cylinder head according to the embodiment.
Figure 4:
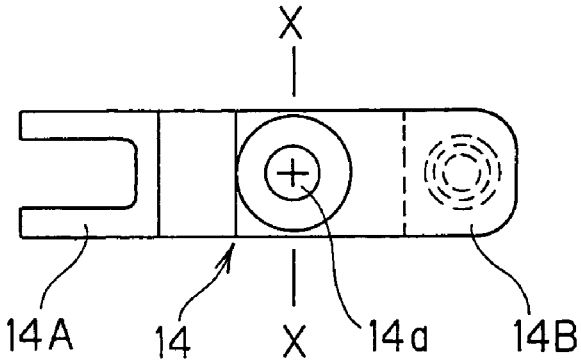
FIG. 4 is a plan view of a nozzle pressing arm according to the embodiment.

FIGS. 1–4 show the main parts of a cylinder head constitution in a direct injection engine comprising an overhead cam, four-valve mechanism to which this invention is applied. In FIGS. 2 and 3, the valve mechanism is illustrated at the front part of the cross-section in order to clarify the positional relationships of the components.

The direct injection engine comprises a cylinder head 11, a nozzle-mounting hole part 12 (or mounting hole), a fuel injection nozzle 13, a nozzle pressing arm 14, a fixing bolt 15, a camshaft 16, an intake valve 17, an exhaust valve 18, and cylinder head bolts 19 and 20.

The fuel injection nozzle 13 is inserted into the mounting hole part 12 so that a nozzle part 13*a* on its tip end faces the combustion chamber. The fuel injection nozzle 13 has a central axis or longitudinal axis. A large diameter nozzle body part 13*b* is connected to the nozzle part 13*a*, which has a small diameter. A shoulder part 13*c* provided around the connection part between the small diameter nozzle part 13*a* and the large diameter nozzle body part 13*b* contacts a step part 12*a* formed at a point on the nozzle mounting hole part 12. Thus positioning of the fuel injection nozzle 13 in its axial direction is performed. As will be described below, the step part 12*a* of the nozzle mounting hole part 12 receives an axial load which acts on the fuel injection nozzle 13 from the bolted nozzle pressing arm 14. A second shoulder part 13*d* which abuts against a pressing part 14A of the nozzle pressing arm 14 is provided at the upper part of the nozzle body part 13*b*.

As shown in FIGS. 4–7, the nozzle pressing arm 14 comprises a through hole 14*a* in the substantially central part thereof. The through hole 14*a* is penetrated by the fixing bolt 15 in an orthogonal direction to the longitudinal axis of the nozzle pressing arm 14. The nozzle pressing arm 14 comprises the pressing part 14A on one side of the through hole 14*a* and a supported part 14B, which contacts a fulcrum of the nozzle pressing arm 14, on the other side of the through hole 14*a*. Hence the nozzle pressing arm 14 functions as a so-called third class lever. The fixing bolt 15 is positioned beside the fuel injection nozzle 13 in the cylinder head 11 so as to fix the nozzle pressing arm 14 in relation to the cylinder head 11. Accordingly, the fixing bolt 15 is attached to the cylinder head 11 through the nozzle pressing arm 14.

Figure 5:
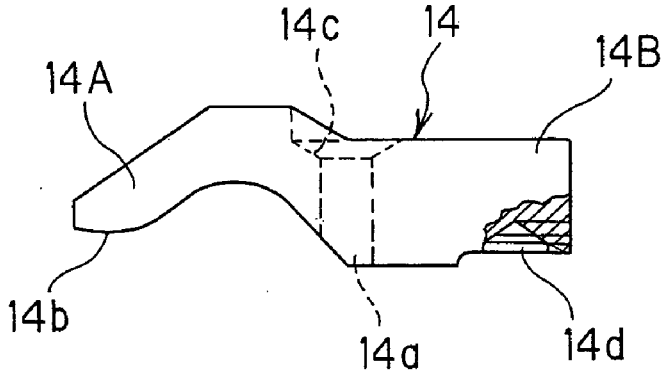
FIG. 5 is a front view of the nozzle pressing arm.
Figure 6:
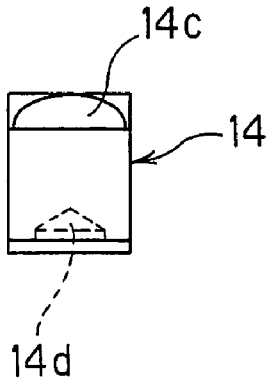
FIG. 6 is a side view of the nozzle pressing arm.

The pressing part 14A of the nozzle pressing arm 14 is formed in a fork shape or U shape so that when it is bolted by the fixing bolt 15, a uniform axial load is applied to the fuel injection nozzle 13 from both sides of the central axis of the fuel injection nozzle 13. As shown in FIG. 5, the front face of the pressing part 14A is formed as an upwardly convex curve. As a result, the nozzle pressing arm 14 is disposed so as to pass over the camshaft 16 when bolted to the cylinder head 11, thereby avoiding interference with the camshaft 16. An abutting surface 14*b* at the base of the pressing part 14A, which abuts against the nozzle shoulder part 13*d*, is also formed with a curved surface. In so doing, the nozzle pressing arm 14 is permitted a certain degree of rotation around the X—X line in the drawing when the nozzle pressing arm 14 is bolted.

A tapered counterbore part 14*c* is formed in the upper end part of the through hole 14*a* so that a washer 22 having a curved face can be interposed between the nozzle pressing arm 14 and the fixing bolt 15. Further, a tapered or conical recessed part 14*d* which constitutes a pivot for the nozzle pressing arm 14 together with the cylinder head bolt 20 is formed on the lower surface of the arm supported part 14B.

Figure 7:
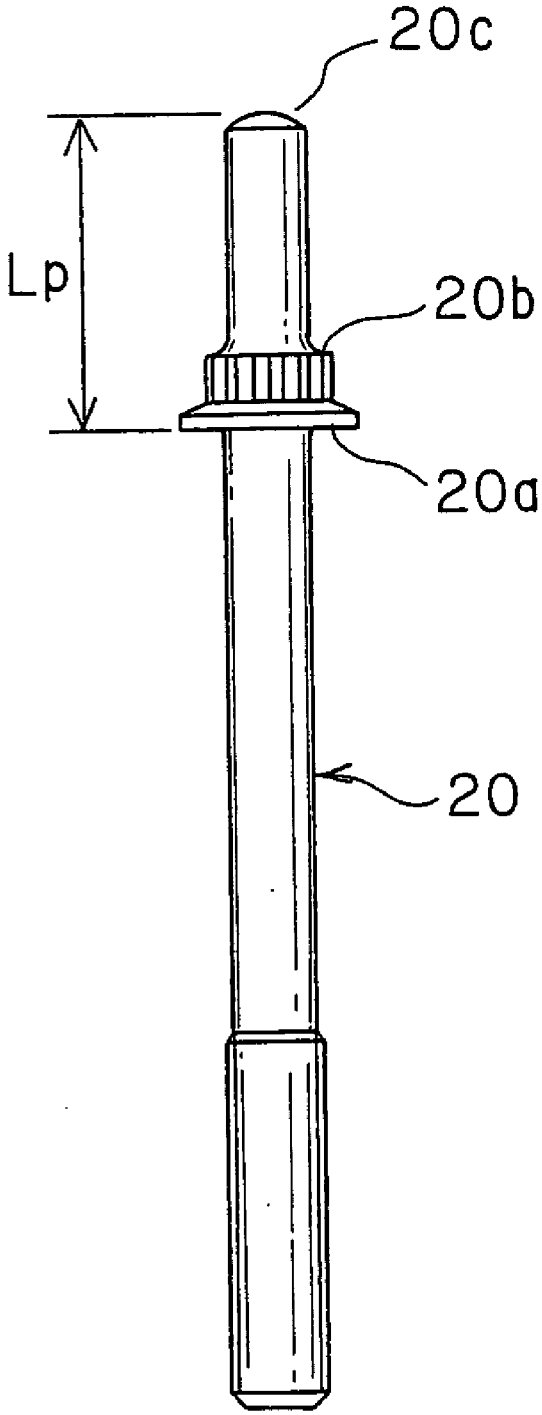
FIG. 7 is a front view of a cylinder head bolt used in the embodiment.

The cylinder head bolts 19, 20 penetrate through holes 11*a* to fasten the cylinder head 11 to an upper deck part of a cylinder block, not shown in the drawings. The through holes 11*a* are formed in a vertical direction in the required locations of the cylinder head 11. The through holes 11*a* and the cylinder head bolts 19, 20 extend substantially parallel to the axial direction of the fuel injection nozzle 13. The cylinder head bolts 19, 20 are positioned beside the fuel injection nozzle 13. One of the cylinder head bolts 19 may be a typical hexagonal bolt. The other cylinder head bolt 20 is a flanged bolt having a flange part 20*a* and a tool-engaging part 20*b* for engaging a tightening tool formed at points on the shaft part, as shown in FIG. 7.

A convex part 20*c* is formed integrally with the cylinder head bolt 20 at the upper end part of the cylinder head bolt 20 by machining or cutting the upper end of the cylinder head bolt 20 into a curved form (or spherical form). The convex part 20*c* is fitted into the recessed part 14*d* formed in the supported part 14B of the nozzle pressing arm 14. Referring to FIG. 2, the convex part 20*c* serves as a fulcrum for the nozzle pressing arm 14, and constitutes a pivot part 21 for the nozzle pressing arm 14 together with the recessed part 14*d*. The axial position of the flange part 20*a* on the cylinder head bolt 20, or in other words a length Lp from the flange part 20*a* to the convex part 20*c* is preferably set in advance. The flange part 20*a* restricts the protrusion height of the cylinder head bolt 20 from the cylinder head 11 to a predetermined amount when the cylinder head bolt 20 is fastened to the cylinder block. As a result, the height of the pivot part 21 is substantially equal to the pressing part 14A or the nozzle shoulder part 13*d* when the cylinder head bolt 20 bolts the cylinder head 11 to the cylinder block through a washer 25 and the fixing bolt 15 bolts the nozzle pressing arm 14 to the cylinder head 11, as shown in FIG. 2. The cylinder head bolt 20 constituting the pivot part 21 is not limited to the flanged bolt shown in the drawings, and may be a common stud bolt which fastens the cylinder head 11 to the cylinder block in combination with a nut.

When the cylinder head 11 and cylinder block are to be joined, the cylinder head bolts 19, 20 are positioned according to bolt holes in the cylinder block. The cylinder head 11 is positioned by a dowel collar or dowel pin that is interposed between the contact surfaces of the cylinder block and cylinder head 11 so as to engage with both. The nozzle pressing arm 14 is then attached so that the recessed part 14*d* in the supported part 14B of the nozzle pressing arm 14 abuts against the convex part 20*c* on the upper end part of the cylinder head bolt 20, and so that the abutting surface 14*b* on the pressing part 14A of the nozzle pressing arm 14 abuts against the shoulder part 13*d* of the fuel injection nozzle 13. The nozzle pressing arm 14 is then bolted to the cylinder head 11 using the washer 22 and the fixing bolt 15. As a result, the nozzle pressing arm 14 is precisely orthogonal to the axial direction when seen from above (FIG. 1), and the nozzle pressing arm 14 is precisely positioned in a horizontal state so that the pivot part 21 and pressing part abutting surface 14*b* are at substantially equal heights along the axial direction when seen from the front.

When the fixing bolt 15 is tightened, the nozzle pressing arm 14 applies a clamping force (in other words, an axial load) from the pressing part 14A to the fuel injection nozzle shoulder part 13*d* with the pivot part 21 serving as a fulcrum. As a result of this axial load, the fuel injection nozzle 13 is fixed securely between the pressing part 14A and the step part 12*a* of the mounting hole in the cylinder head 11.

In this embodiment, the pivot part 21 which supports the nozzle pressing arm 14 is provided on the upper end part of the cylinder head bolt 20 which passes through the cylinder head 11 and engages with the cylinder block. The cylinder head bolt 20 which reaches the cylinder block has great rigidity. Hence, in comparison with the fixing structure of the prior art, in which a supporting additional pin is implanted in the top of the cylinder head 11, the fixing structure for a fuel injection nozzle of this embodiment is able to ensure sufficient rigidity.

The fixing structure for the fuel injection nozzle 13 forms a highly rigid support structure by which the nozzle pressing arm 14 is positioned precisely on the cylinder head 11, and by which the cylinder head bolt 20, which forms the fulcrum (pivot part 21) of the nozzle pressing arm 14, does not easily succumb to slanting, deformation, or distortion. Further, when the nozzle pressing arm 14 is fastened by the fixing bolt 15, a certain degree of rotation is permitted about the pivot part 21, and hence even when there is a slight difference in the respective heights the pivot part 21 and pressing part 14A, the occurrence of an offset load caused by this difference can be avoided. As a result, offset loads in a transverse direction or curving direction do not act on the fuel injection nozzle 13, and thus the fuel injection nozzle 13 is fixed by a load which acts only in a precisely axial direction. Accordingly, the danger of a deterioration in the operating performance of the fuel injection nozzle 13 caused by the action of an offset load can be eliminated.

The nozzle fixing structure of this embodiment can be employed as long as there is enough space to dispose the cylinder head bolt 20 on one side of the fuel injection nozzle 13. Hence, this nozzle fixing structure has little effect on the constitution and layout of the cylinder head, and does not require any great alterations of the pre-existing cylinder head.

The entire contents of Japanese Patent Application P2003-409172 (filed Dec. 8, 2003) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A nozzle fixing structure which fixes a fuel injection nozzle used in an engine having a cylinder block and a cylinder head, the nozzle fixing structure comprising:

a nozzle pressing arm which fixes a fuel injection nozzle positioned above a combustion chamber of the engine to the cylinder head, the nozzle pressing arm comprising a through hole;

a fixing bolt which is passed through the through hole in the nozzle pressing arm and tightened to the cylinder head in order to fix the nozzle pressing arm above the cylinder head; and a cylinder head bolt which is passed through the cylinder head and tightened to the cylinder block in order to fix the cylinder head to the cylinder block, an upper end of the cylinder head bolt supporting the nozzle pressing arm and constituting a pivot part for the nozzle pressing arm;

wherein the nozzle pressing arm comprises:

a pressing part formed on one side of the through hole, the pressing part causing a load to act on the fuel injection nozzle in an axial direction of the fuel injection nozzle when the fixing bolt is tightened to the cylinder head; and a supported part formed on another side of the through hole, the supported part being supported by the upper end of the cylinder head bolt, and the supported part constituting the pivot part for the nozzle pressing arm together with the upper end of the cylinder head bolt.

2. The nozzle fixing structure as defined in claim 1, wherein the cylinder head bolt has a length which causes the pivot part to have a substantially equal height to the pressing part of the nozzle pressing arm.

3. The nozzle fixing structure as defined in claim 1, wherein the pivot part comprises:

a tapered recessed part formed on a lower surface of the supported part of the nozzle pressing arm; and a convex part having a curved surface, which is provided on the upper end of the cylinder head bolt so as to be fitted within the recessed part.

4. The nozzle fixing structure as defined in claim 3, wherein the convex part comprises a curved surface that is formed by machining the upper end of the cylinder head bolt.

5. The nozzle fixing structure as defined in claim 1, wherein a washer having a curved surface is interposed between the nozzle pressing arm and the fixing bolt, and a tapered counterbore part is formed around the through hole so that the washer is fitted therein.

6. The nozzle fixing structure as defined in claim 1, wherein the cylinder head bolt comprises a flange part which restricts a protrusion height of the cylinder head bolt from the cylinder head to a predetermined amount when the cylinder head bolt is fastened to the cylinder block.

7. The nozzle fixing structure as defined in claim 1, wherein the cylinder head comprises a plurality of intake valves and exhaust valves surrounding the fuel injection nozzle, and thereabove comprises a camshaft which drives the intake valve and a camshaft which drives the exhaust valve, the nozzle pressing arm being fixed with respect to the cylinder head so as to pass over one of the camshafts.

* * * * *